US005410854A

United States Patent [19]

Kimmell et al.

[11] Patent Number: 5,410,854

[45] Date of Patent: May 2, 1995

[54] CONNECTOR BRACKETS

[76] Inventors: Bruce A. Kimmell, 8722 Lamar Ave., O'Dessa, Tex. 79765; Jerry W. Gebrosky, 2852 Seville Cir., Antioch, Calif. 94509

[21] Appl. No.: 149,462

[22] Filed: Nov. 9, 1993

[51] Int. Cl.[6] ..... E04B 1/38

[52] U.S. Cl. ..... 52/712; 52/715; 411/465

[58] Field of Search ..... 52/712, DIG. 6, 715, 52/696; 411/442–444, 457–461, 469, 471, 477, 462–466; 248/220.1, 300

[56] References Cited

U.S. PATENT DOCUMENTS

| | | | |
|---|---|---|---|
| 450,753 | 4/1891 | Cary . | |
| 839,836 | 1/1907 | Greenfield | 411/444 |
| 1,320,303 | 10/1919 | Young | 411/465 |
| 1,724,288 | 8/1929 | Brecque | 411/461 |
| 2,396,030 | 3/1946 | Terry | 138/78 |
| 2,863,352 | 12/1958 | Mikesic | 85/11 |
| 3,305,252 | 2/1967 | Jureit | 52/712 |
| 3,325,585 | 6/1967 | Brenneman | 411/460 X |
| 4,209,265 | 6/1980 | Moehlenpah | 403/230 |
| 4,308,703 | 1/1982 | Knowles | 52/694 |
| 4,490,956 | 1/1985 | Palacio | 52/712 X |
| 5,026,015 | 6/1991 | Patrick | 248/248 |
| 5,234,279 | 8/1993 | Poutanen | 411/466 X |

FOREIGN PATENT DOCUMENTS

| | | | |
|---|---|---|---|
| 209915 | 1/1924 | United Kingdom | 411/464 |

OTHER PUBLICATIONS

Simpson Strong-Tie Company, Inc., 1993 Catalog, pp. 44, 50.

*Primary Examiner*—Carl D. Friedman
*Assistant Examiner*—Beth A. Aubrey

[57] ABSTRACT

The present invention is a connector bracket of one piece construction that comprises a structural plate having a first portion contiguous with a second portion in a common plane and positioned in mutually staggered alignment. Each of the portions has a pair of bent-over opposing edges that extend in a common direction away from the plate as a linear series of spikes. As such, the spikes, when driven into a pair of adjoining coplanar surfaces, enable the bracket to hold the surfaces in a mutually fixed position. The staggered alignment of the spikes of each portion prevents the splitting of the surfaces.

6 Claims, 2 Drawing Sheets

CONNECTOR BRACKETS

FIELD OF THE INVENTION

This invention relates generally to connector brackets for holding two surfaces together, and, more particularly, is directed towards a connector bracket having spikes in staggered alignment for preventing the splitting of the surfaces.

BACKGROUND OF THE INVENTION

Connector brackets for holding structural members together in a fixed relationship are well known in the construction industry. Various shapes and sizes of brackets exist for holding wood beams and the like together for strengthening a building structure. Many such brackets are illustrated, for example, in the product catalogs of Simpson Strong-Tie® Company, Inc., and in various prior art patents such as:

| U.S. Pat. No. | Inventor | Issue Date |
|---|---|---|
| 4,308,703 | Knowles | 1/5/82 |
| 4,209,265 | Moehlenpah | 6/24/80 |
| 2,863,352 | Mikesic | 12/9/58 |
| 2,396,030 | Terry | 3/5/46 |
| 1,320,303 | Young | 10/28/19 |
| 450,753 | Cary | 4/21/1891 |

To reduce manufacturing costs, such prior art devices are often formed by a stamping process and from a single piece of sheet material. The Knowles patent teaches such a device and includes a bracket with two plate sections linked by a channel section. Each plate section includes stamped-out teeth for engaging a wooden beam, or the like. Such teeth, however, are not barbed and can therefore be pulled out of the wooden beam relatively easily. Further, such a bracket is not well suited for fixing together two orthogonal surfaces.

Conversely, the Moehlenpah patent teaches an L-shaped bracket device for holding together two orthogonal adjoining surfaces. However, such a device is not well suited for holding together two coplanar surfaces. Further, such a device has non-barbed teeth such as in the Knowles device, and can therefore be pulled out of the wooden beam or other mounting surface relatively easily.

As is typical in the prior art, most connector brackets are only useful for a limited number of specific fastening applications, and are therefore not universally useful. Further, many of the prior art devices have mounting teeth or nail holes aligned in such a way that splitting of the wooden beams into which such devices are mounted is a common problem.

Clearly, then, there is a need for a fastening connector bracket that can be used to fasten together both coplanar and orthogonal surfaces. Such a needed device would be relatively inexpensive to manufacture, and could be stamped from a single piece of sheet material. Further, such a needed device would include barbed portions on protruding teeth for providing a relatively strong hold of the mounting surfaces. Still further, such a needed device would not tend to split the mounting surfaces. The present invention fulfills these needs and provides further related advantages.

SUMMARY OF THE INVENTION

The present invention is a connector bracket of one piece construction that comprises a structural plate having a first portion contiguous with a second portion in a common plane and positioned in mutually staggered alignment. Each of the portions has a pair of bent-over opposing edges that extend in a common direction away from the plate as a linear series of spikes. As such, the spikes, when driven into a pair of adjoining coplanar surfaces, enable the bracket to hold the surfaces in a mutually fixed position. The staggered alignment of the spikes of each portion prevents the splitting of the surfaces.

In an alternate embodiment of the invention, each of the portions are bent at a generally right angle so that a first part of each of the portions share a first common plane, while a second part of each of the portions share a second common plane. The intersection of the first part and the second part of each portion defines a common edge, one portion of which is preferably pierced so as to reduce resistance to movement of the first part relative to the second part. As such, the spikes, when driven into a pair of adjoining orthogonally arranged surfaces, enable the bracket to hold the surfaces in mutually fixed position. The staggered alignment of the spikes of each portion prevents the splitting of the surfaces.

The present invention is a fastening connector bracket that can be used to fasten together both coplanar and orthogonal surfaces. The present device is relatively inexpensive to manufacture, and can be stamped from a single piece of sheet material. Further, the present invention includes barbs on protruding teeth for providing a relatively strong hold of the mounting surfaces. Still further, the present device does not tend to split the mounting surfaces. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
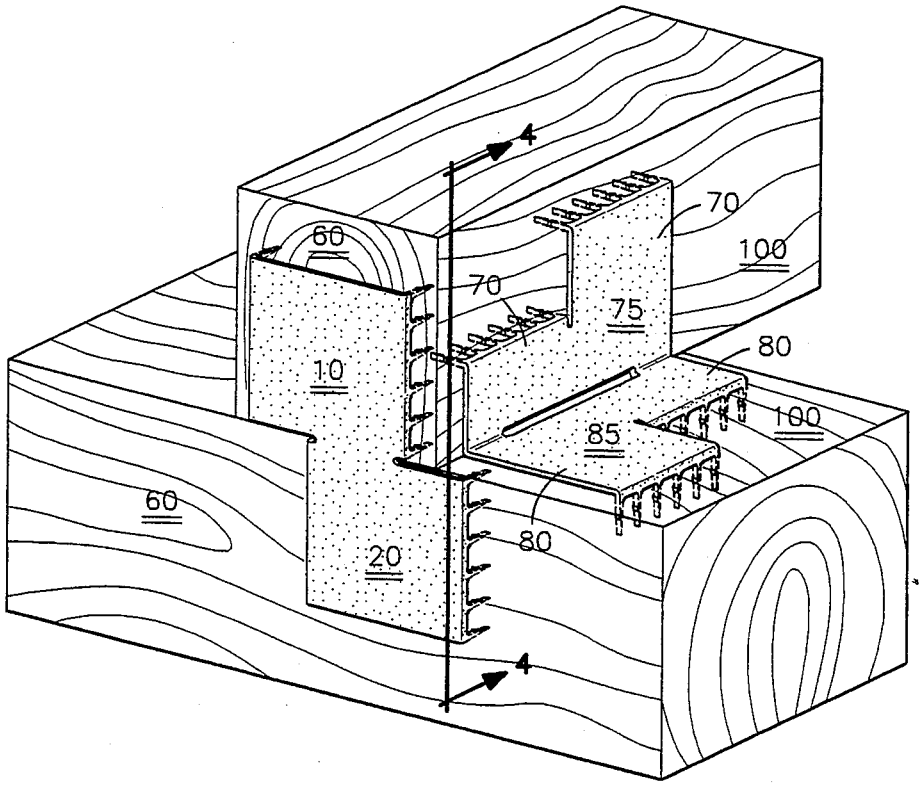
FIG. 1 is a perspective view of the invention, illustrating a generally flat embodiment of the invention for joining two coplanar surfaces, and a bent embodiment of the invention for joining two orthogonally arranged surfaces.
Figure 2:
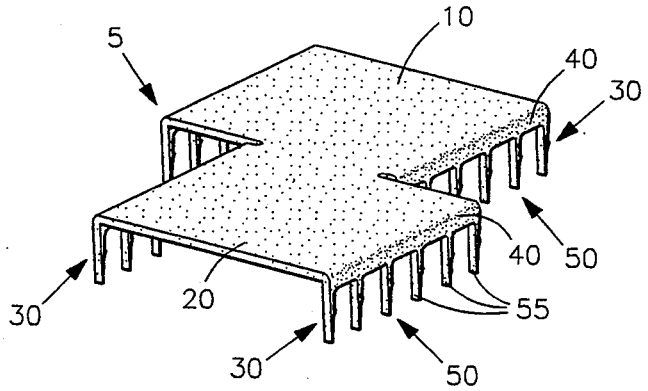
FIG. 2 is a perspective illustration of the generally flat embodiment of the invention, illustrating staggered series of spikes extending from bent-over opposing edges of the invention.

FIGS. 1 and 2 show a connector bracket of one piece construction that comprises a structural plate 5 having at least a first portion 10 contiguous with a second portion 20 in a common plane and positioned in mutually staggered alignment. The plate 5 is preferably fabricated from a rigid, non-brittle sheet material, such as a metal sheet material. Each of the portions 10,20 has a pair of bent-over opposing edges 30 that each form a rigid flange 40 that extends in a common direction away from the plate 5 as a linear series 50 of spikes 55 arranged in parallel alignment. The staggered alignment of the portions 10,20 provide a staggered alignment of the series 50 of spikes 55 on the first portion 10 relative to the second portion 20. In an alternate embodiment of the invention without the rigid flange 40, the bent-over opposing edges 30 extend in a common direction away from the plate 5 as the series 50 of spikes 55.

Figure 5:
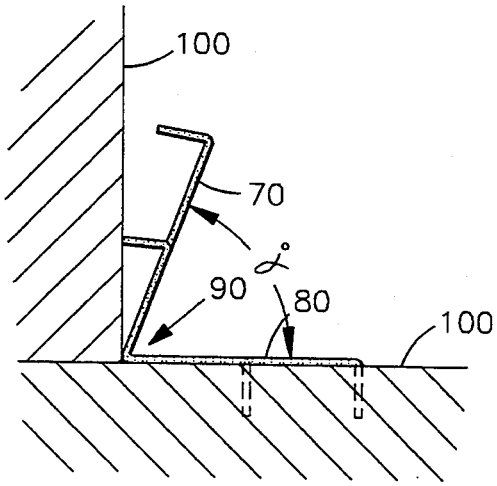
FIG. 5 is a cross-sectional view of the invention, taken generally along lines 4—4 of FIG. 1, and illustrating the bent embodiment of the invention as installed into one of the orthogonally arranged surfaces.
Figure 6:
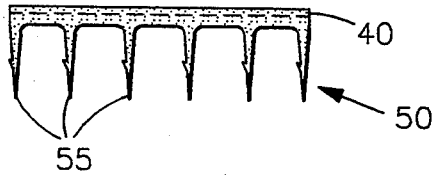
FIG. 6 is a partial front elevational view of the invention, illustrating a linear series of spikes of the invention, each spike including a tapered shank portion and one barb portion.
Figure 7:
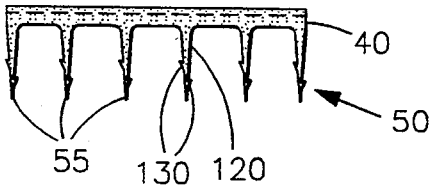
FIG. 7 is a partial front elevational view of the invention, illustrating the linear series of spikes of the invention wherein each spike includes the tapered shank portion and two mutually staggered barb portions.
Figure 8:
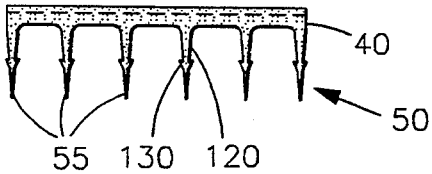
FIG. 8 is a partial front elevational view of the invention, illustrating the linear series of spikes of the invention wherein each spike includes the tapered shank portion and two mutually aligned barb portions.

The spikes 55 and rigid flange 40 of the preferred embodiment, when driven into a pair of adjoining coplanar surfaces 60, enable the bracket to hold the surfaces 60 in a mutually fixed position. The staggered alignment of the spikes 55 reduces the chance of splitting of the surfaces 60. Further, the spikes 55 may include a tapered shank portion 120 and at least one barb portion 130 extending outwardly from the shank portion 120. FIG. 5 illustrates the spikes 55 as with one barb portion 130. FIG. 7 illustrates the spikes 55 as with two mutually staggered barb portions 130. FIG. 8 illustrates the spikes 55 as with two mutually aligned barb portions 130. As such, the barb(s) 130 provide improved resistance to withdrawal of the shank portion 120 from the surface 60. While FIGS. 6–8 show the series 50 of spikes 55 comprising six spikes each, clearly any number of spikes 50 may comprise a series 50 of spikes 55.

Figure 3:
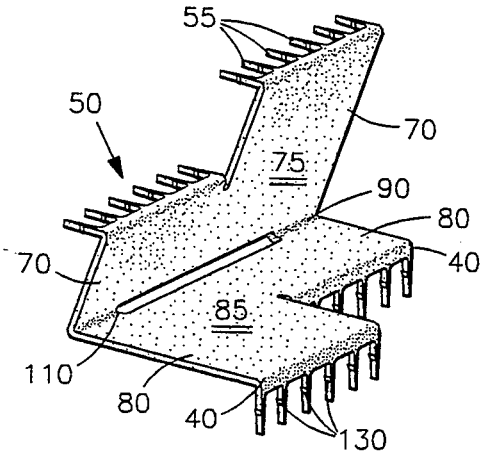
FIG. 3 is a perspective illustration of the bent embodiment of the invention, illustrating a pierced portion of a common edge of a first part and a second part of the invention.
Figure 4:
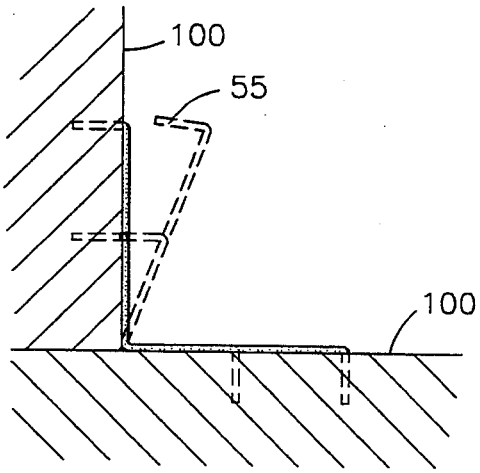
FIG. 4 is a cross-sectional view of the invention, taken generally along lines 4—4 of FIG. 1, and illustrating the bent embodiment of the invention as installed into two orthogonally arranged surfaces and, in phantom outline, as installed into only one of the orthogonally arranged surfaces.

In an alternate embodiment of the invention, illustrated in FIGS. 1 and 3, each of the portions 10,20 are bent at an angle $\alpha$ so that a first part 70 of each of the portions 10,20 share a first common plane 75, while a second part 80 of each of the portions 10,20 share a second common plane 85. The intersection of the first part 70 and the second part 80 of each portion 10,20 defines a common edge 90, one portion 110 of which is preferably defining a slot opening so as to reduce resistance to movement of the first part 70 of the portions 10,20 relative to the second part 80 of the portions 10,20 (FIG. 3). As a result, a worker can bend the bracket with a pair of pliers into the desired embodiment, for example. Preferably, the angle $\alpha$ is of a magnitude such that with the common edge 90 abutting one of the surfaces 100, the tips of the spikes 55 of the first part 70 of at least one of the portions 10,20 are in contact with said surface 100 (FIG. 5), whereby the plate may be easily brought into contact with both of the surfaces 100 (FIG. 4) before installation. The spikes 55 of the first part 70 of each of the portions 10,20 are formed at such an angle with respect to the first part 70 that the tip of each spike 55 enters the one surface 100 at a position that is immediately adjacent to the rigid flange 40 when the portion 10,20 abuts the one surface 100. That is to say that the angle of the spikes 55 of each portion 10,20 of the first part 70 with respect to the first part 70 is such that the spikes 50 will penetrate the one surface 100 orthogonally, thereby not causing the surfaces 100 to move into compression against each other nor to move apart.

As such, the spikes 55, when driven into a pair of adjoining orthogonally arranged surfaces 100, hold the surfaces 100 in mutually fixed position. As in the first embodiment of the invention, the staggered alignment of the spikes 55 of each portion 10,20 reduce the chance of splitting of the surfaces 100.

In another embodiment of the invention, the series 50 of spikes 55 are replaced with a single prong (not shown) for engaging a hole in a metallic beam, such as the aluminum beams that are becoming more common in construction. Such an embodiment would allow quick, inexpensive fastening of a metallic beam to either another metallic beam or to a wood beam.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A one piece construction connector bracket comprising a structural plate having a plurality of contiguous portions in a common plane and positioned in mutually staggered alignment, each of the portions having a pair of bent-over opposing edges, with each of the edges extending, in a common direction, away from the plate as a linear series of spikes arranged in parallel alignment, the staggered alignment of the portions resulting in a staggered alignment of the series of spikes on one of the portions relative to the series of spikes on the other of the portions, whereby the spikes, when driven into a pair of adjoining coplanar surfaces, hold the surfaces in a mutually fixed position, the staggered alignment of the spikes reducing the probability of splitting of the surfaces.

2. A one piece construction connector bracket comprising a structural plate having a plurality of contiguous portions, each of the portions being bent at a near right angle so that a first part of each of the portions share a first common plane, while a second part of each of the portions share a second common plane, the intersection thereof defining a common edge, the portions being positioned in mutually staggered alignment, each of the portions having a pair of bent-over opposing edges, with each of the edges of the first part, and of the second part, of each of the portions extending, in a common direction, away from the plate as a linear series of spikes arranged in parallel alignment, the staggered alignment of the portions providing a staggered alignment of the series of spikes on one of the portions relative to the series of spikes on the other of the portions, whereby the spikes, when driven into a pair of adjoining orthogonally arranged surfaces, enable the bracket to hold the surfaces in a mutually fixed position, the staggered alignment of the spikes reducing the probability of splitting of the surfaces.

3. The one piece construction connector bracket of claim 2 wherein the near right angle is of a magnitude such that with the common edge abutting the intersection of the surfaces, the tips of the spikes of the first part of at least one of the portions lay in contact with the one of the surfaces, whereby the structural plate may be easily brought into contact with both of the surfaces.

4. The one piece construction connector bracket of claim 3 wherein the plate defines a slot opening along a portion of the common edge so as to reduce resistance to movement of the first part of the portions relative to the second part of the portions as the first part is moved to abut one of the surfaces.

5. The one piece construction connector bracket of claim 1 wherein each of the spikes includes a tapered shank portion and at least one barb portion extending outwardly from the shank portion, the barb portion providing resistance to withdrawal of the shank portion from one of the surfaces.

6. The one piece construction connector bracket of claim 3 wherein the spikes of the first part of each of the portions are formed at such an angle with respect to the first part, that the tip of each of said spikes enters the one of the surfaces at a position adjacent to the shoulder of the spike when the portion abuts the one surface.

* * * * *